United States Patent [19]

Sterwerf, Jr.

[11] Patent Number: 4,717,206

[45] Date of Patent: Jan. 5, 1988

[54] ENDLESS CHAINS COMPRISED OF INTERDIGITATED LINK ELEMENTS HAVING A Y-SHAPED CONFIGURATION

[75] Inventor: Lester J. Sterwerf, Jr., Harrison, Ohio

[73] Assignee: The Cincinnati Mine Machinery Company, Cincinnati, Ohio

[21] Appl. No.: 729,570

[22] Filed: May 2, 1985

[51] Int. Cl.[4] ..... E21C 27/26; E21C 25/34

[52] U.S. Cl. ..... 299/82; 474/223

[58] Field of Search ..... 299/82–84; 474/206, 219, 223, 226; 59/4, 5, 7, 8

[56] References Cited

U.S. PATENT DOCUMENTS

| | | | |
|---|---|---|---|
| 1,028,893 | 6/1912 | Luther | 474/219 |
| 1,694,275 | 12/1928 | Merwin | 474/219 |
| 2,068,666 | 1/1937 | Dunlop | 474/206 X |
| 2,398,107 | 4/1946 | Morrow | 474/223 |
| 2,569,584 | 10/1951 | Shepherd-Smith | 299/84 |
| 3,463,026 | 8/1969 | Staub et al. | 299/82 |
| 3,679,265 | 7/1972 | Krekeler | 299/84 |
| 3,841,707 | 10/1974 | Kniff et al. | 299/84 |
| 3,888,133 | 6/1975 | Krekeler | 299/82 X |
| 4,265,084 | 5/1981 | Livesay | 59/7 |

FOREIGN PATENT DOCUMENTS

| | | | |
|---|---|---|---|
| 1166720 | 4/1964 | Fed. Rep. of Germany | 299/82 |
| 1054399 | 1/1967 | United Kingdom | 299/82 |

*Primary Examiner*—George A. Suchfield
*Attorney, Agent, or Firm*—Frost & Jacobs

[57] ABSTRACT

An endless chain in which there is one row of a plurality of Y-shaped link elements across the width of the chain and an adjacent row of similar elements, the spaced parallel legs of the Ys of one row having the centrally located stem of a Y-shaped link element in an adjacent row interdigitated therewith, the legs and stem being provided with aligned openings which receive a connecting pin. This arrangement is continued along the length of the chain to whatever extent is desired. Any desired widths may be obtained by adding Y-shaped link elements to the rows thereof. Bit carrying lugs are mounted on the Y-shaped link elements so as to establish any bit pattern desired. Some of these bit carrying lugs may be skewed with respect to the direction of chain travel so as to make the chain more efficient. Such link elements may also be provided with load bearing lugs at one or more of the their sides so as to give increased support for the chain. The arrangement of interdigitated, Y-shaped link elements makes possible the provision of an unusually sturdy chain requiring only a minimum number of major chain parts so that the mine owner or operator need stock only a relatively small number of parts, both as to type and as to overall quantity.

32 Claims, 25 Drawing Figures

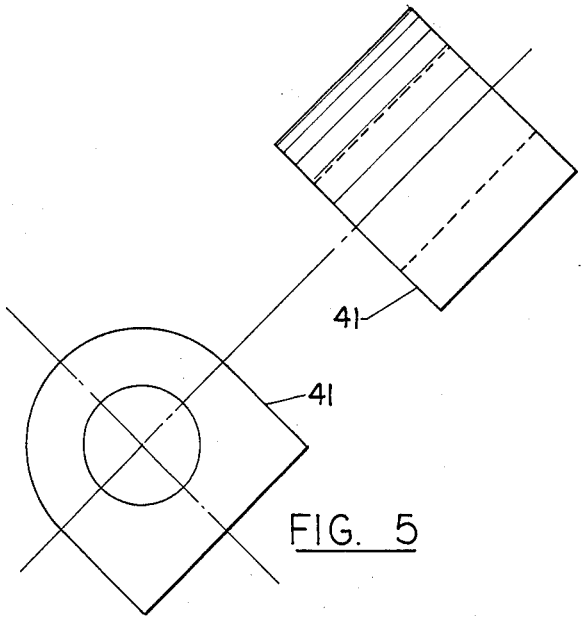
FIG. 4
FIG. 5
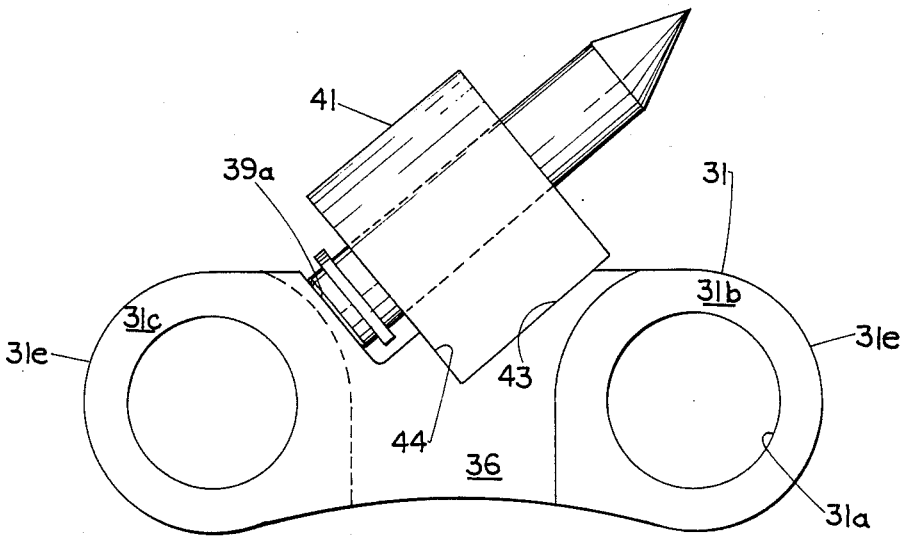
FIG. 6

ENDLESS CHAINS COMPRISED OF INTERDIGITATED LINK ELEMENTS HAVING A Y-SHAPED CONFIGURATION

TECHNICAL FIELD

The invention relates to a novel chain construction by which the chain may be varied both in length and in width and which may be adapted to carry cutting tools in any desired pattern or arrangement, but which requires only a relatively small number of standardized parts for its construction. While the chain of the present invention may have many applications, as will be described hereinafter, it is particularly useful as a trim chain for a drum-type mining machine. In more general terms, however, the invention relates to the mining and construction industries, including the mining of coal, potash, salt, gypsum and other substances, and including also earth working, trenching and road scarifying and planing equipment.

BACKGROUND ART

Drum-type mining machines have come into extensive use. Briefly, such machines generally comprise a self-propelled vehicle having a centrally located conveyor means for removing the material being mined. At the forward end of the machine, one or more movable beams support a horizontally oriented drum. The drum bears a plurality of cutting tools. Frequently, the cutting tools are oriented on the drum in a pattern comprising two oppositely oriented helices which are directed toward the center of the drum. This aids in conducting the cut material toward the center of the machine and the conveyor which forms a part of it.

Through an appropriate drive mechanism and gearing, in association with the beam or beams, the drum is caused to rotate about its axis to produce the cutting action. In the usual practice, the machine is brought to the face of the material being cut and the drum is sumped into the face at the top thereof. Thereafter, through the agency of the beam or beams, the rotating drum is caused to move downwardly, making a complete vertical cut at the face of the material. This procedure is then repeated and the mine entry is thereby advanced.

At the position or positions where the drum is supported on one or more of the beams, the drum cannot carry cutting tools. Therefore, one or more trim chains are required to fill in those portions of the drum not otherwise provided with cutting tools. By virtue of the construction of such mining machines, it often develops that the trim chains have to be of considerable width. As a consequence, such trim chains usually carry a plurality of cutting tools located in patterns of staggered rows extending the width of the chain, so that the chain will make a full width cut.

The earlier of such trim chains were comprised of a plurality of chain blocks joined together by two or more connecting links. Each block was as wide as the chain width required and each carried at least one cutting tool in a predetermined position along the chain width. Thus, for each cutting tool position there had to be a separate type of chain block configured to mount the cutting tool in that position.

These earlier trim chains performed fairly well in the field but they required the mine owner to carry a large inventory of different and expensive wide chain blocks for purposes of replacement and repair. In addition, since some mine owners could have several different drum-type mining machines, each using trim chains of different widths, he would then be required to maintain an inventory of sets of wide chain blocks for each type of machine.

Improvement on these wide block trim chains, however, has been made. Such improvement has generally taken the form of a chain construction in which the trim chain is comprised of a plurality of interdigitated link elements, some of which are simply connecting links, and some of which are bit carrying links. Spacer means may be substituted for selected ones of the connecting links or of the bit carrying links and as a consequence the term "link element" is generally construed as encompassing connecting links, bit carrying links and spacer means.

Improved trim chains of the type just mentioned are shown in U.S. Pat. Nos. 3,679,265 and 3,888,133. These improved trim chains are made up of a plurality of transverse rows of link elements with any desired arrangement of connecting links and bit carrying links. The number of elements in each row may be varied so as to provide a trim chain of any desired width. As indicated, the ends of the lik elements of adjacent rows are interdigitated and held together by connecting pins of appropriate length passing through coaxial perforations in the interdigitated link element ends. These chains may be driven by sprocket means engaging the ends of select link elements at selected positions along the width of the chain, or by engaging the ends of the connecting pins.

The aforementioned patents make other teachings which may also be incorporated in the chain of the instant invention. Thus, for example, it is taught that spacer elements may be substituted for a connecting link, for purposes of economy. Not only may the bits be located in various patterns on the selected link elements but also the bit may be skewed; that is, selected bits may be in line with the axis of the chain and the direction of chain movement, i.e., the cutting direction, while other bits may be oblique thereto. These patents also teach means for retaining the connecting pins in the chain and for protecting them from wear. It is also taught in these patents that chains of this general type may be modified to serve as a tread for a self-propelled vehicle and it is indicated that when so used all of the link elements comprising the chain may be identical, or the chain may be comprised of a plurality of standard link elements and a plurality of modified link elements to produce various desired results. These features, and others, may be incorporated in the instant invention.

DISCLOSURE OF THE INVENTION

The present invention is directed to an endless chain comprised of interdigitated link elements in which the primary link elements have a Y-shaped configuration. This results in a chain having the flexibility of the prior art chains, the ability to provide for a variety of bit patterns, and the necessity of stocking only a relatively few chain parts, while at the same time providing a more stable chain of rugged construction. Each Y-shaped (when viewed in plan) link element may have one or more bit carrying lugs placed thereon in a variety of positions and this further contributes to the ability to make up chains having a wide variety of bit patterns. Thus, the invention makes it possible to achieve a rugged chain of any desired width or length, within practical ranges, while using only a relatively few types and quantities of major link elements, and at the same time making possible a wide variety of bit patterns.

BRIEF DESCRIPTION OF THE DRAWINGS

FIG. 4 is a side view of a bit carrying lug element which may be employed with the Y-shaped link element of this invention.

FIG. 5 is a front elevation of a bit carrying lug element which may be used with the Y-shaped link element of this invention.

FIG. 6 is a side elevation of a Y-shaped link element according to this invention with a bit carrying lug element affixed thereto and depicting a point attack bit located within the bit carrying lug and abutting a portion of the Y-shaped link element.

DETAILED DESCRIPTION OF THE INVENTION

Figure 1:
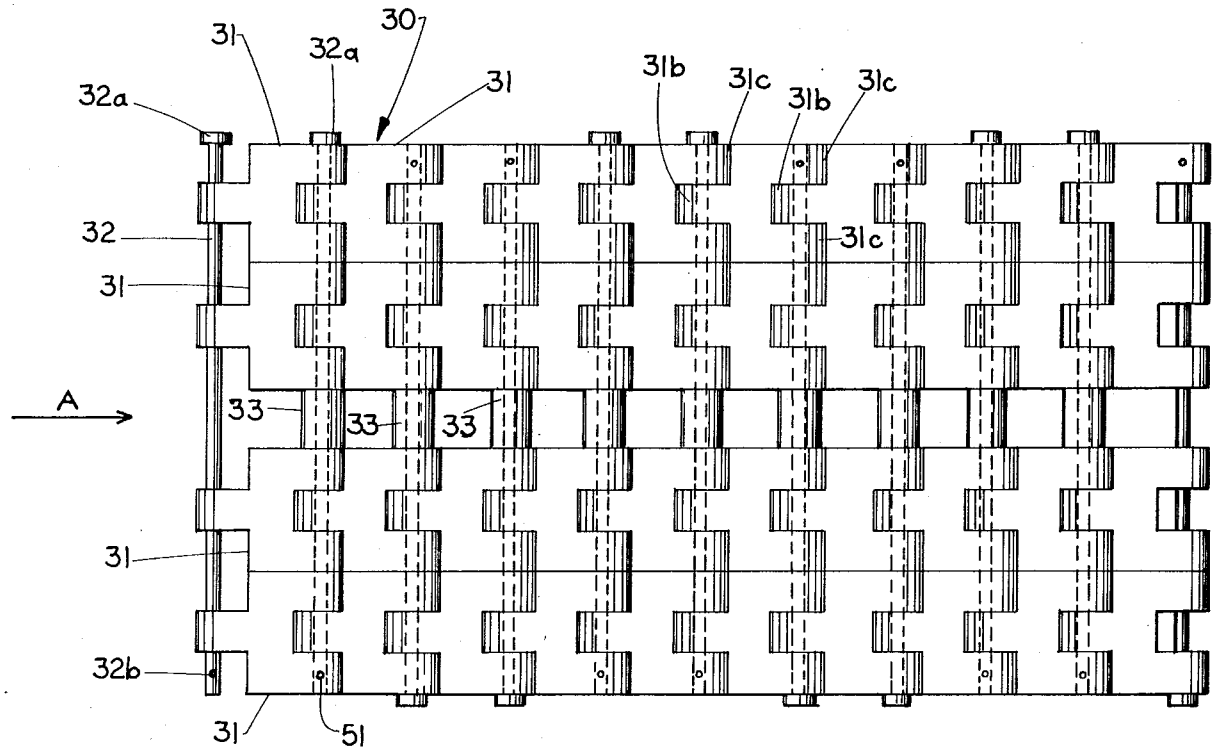
FIG. 1 is a plan view of a section of chain comprised of Y-shaped link elements each having transverse perforations at its forward and rearward ends, the link elements being arranged in lateral rows across the width of the chain, the rows of link elements being located one behind the other with the ends of the link elements of adjacent rows being in intergitated relationship with their transverse perforations coaxially aligned so as to receive a connecting pin which passes therethrough.
Figure 11:
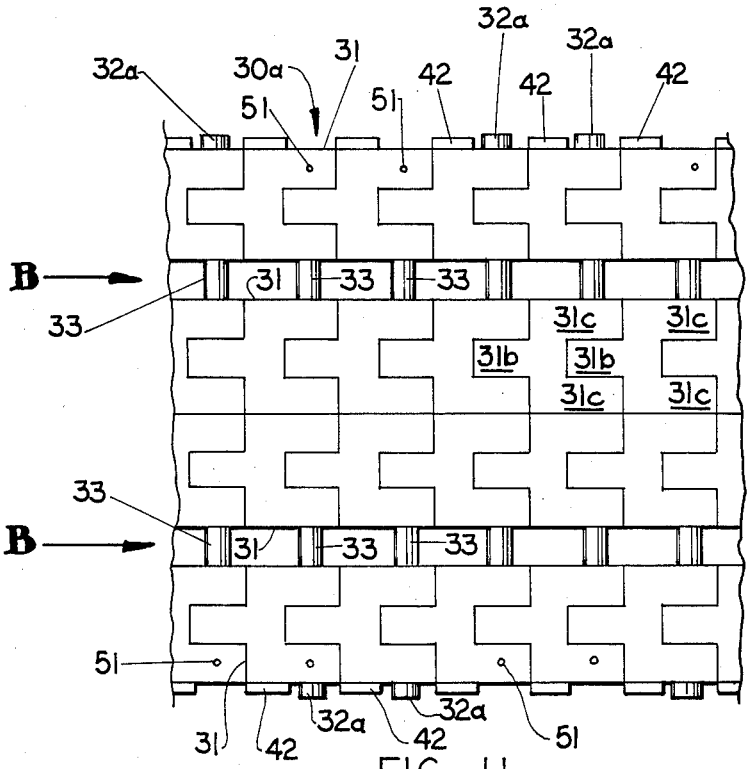
FIG. 11 is a plan view of a section of a chain comprised of Y-shaped link elements and spacer elements arranged so as to effect a drive which is different from that shown in FIG. 1.

Referring first to FIGS. 1, 11, 12 and 13, sections of several different types of chains, each embodying the invention, are illustrated. In FIG. 1 the section of chain 30 is depicted as comprised of a number of link elements 31, some of which will be equipped with bit carrying lugs so as to form a desired bit pattern throughout the chain as is known and understood in the art, all of the link elements, whether equipped with a bit carrying lug or not, being generally shaped like a Y when viewed in plan, the Y-shaped link elements being interdigitated in successive rows and the legs of the various Y-shaped link elements being perforated as at **31*a* (FIG. 2) so as to receive a connecting pin or pintle 32. Spacer elements 33 (FIGS. 1 and 11) may be employed when necessary to lend stability to the chain and to provide for various manners of driving the chains; these elements may be located on the connecting pins between adjacent Y-shaped link elements. The chain 30 of FIG. 1 is designed to be supported at its sides (the top and bottom as viewed in FIG. 1) and to be driven by a sprocket located centrally thereof and having teeth to engage the centrally located spacer elements 33. The area to be engaged by the sprocket is generally indicated by the arrow A in FIG. 1. In FIG. 11 the spacer elements 33 have been arranged so that the chain 30*a* is driven by a pair of sprockets, each located inwardly from the edges of the chain and the area to be engaged by the sprocket is generally indicated by the arrows B in FIG. 11**.

Figure 12:
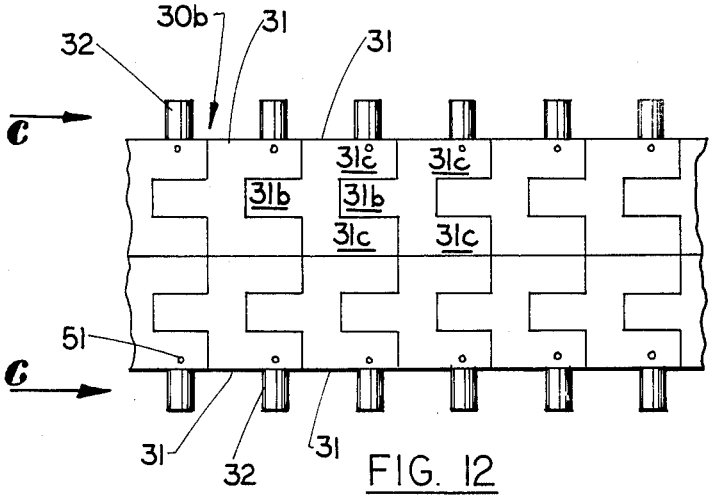
FIG. 12 is a plan view of a section of chain made up of Y-shaped link elements arranged in another pattern so as to effect yet another drive arrangement for the chain.

The chains of FIGS. 1 and 11 are comprised of Y-shaped link elements which are arranged four to a row across the chain if one considers a row as made up of those Y-shaped link elements which are disposed between adjacent pintles or connecting pins 32. (If one considers a row to include the number of Y-shaped link elements engaged by any one connecting pin 32, then there are eight per row in the arrangement of FIGS. 1 and 11.) In FIG. 12 the chain **30*b* is depicted as comprised of two Y-shaped link elements per row (between pintles 32**) or four if one considers the number of Y-shaped link elements on any one of said pintles. Hereinafter a row of Y-shaped link elements will refer to those link elements disposed between adjacent connecting pins or pintles in lateral alignment across the width of a chain.

The chain **30*b* of FIG. 12 is depicted as being approximately half as wide (from top to bottom as viewed in that Fig.) as the chain 30 of FIG. 1 and chain 30*a* of FIG. 11. This chain 30*b* is adapted to be driven by sprockets which engage the protruding ends of the connecting pins 32. The arrows C further indicate the place of drive for the chain 30***b* of FIG. 12. No spacer elements are required for the chain 30*b*.

The chain 30*a* of FIG. 11 is approximately the same width as the chain 30 fo FIG. 1 but the Y-shaped link elements are arranged somewhat differently so that the chain may be driven by a pair of sprockets which engage spacer elements 33 located on connecting pins 32 in the areas indicated by the pair of arrows marked by the letter B. These spacer elements 33 are so located on the connecting pins 32 as to separate the endmost Y-shaped link element on each row from the two abutting Y-shaped link elements located centrally of that row.

Figure 13:
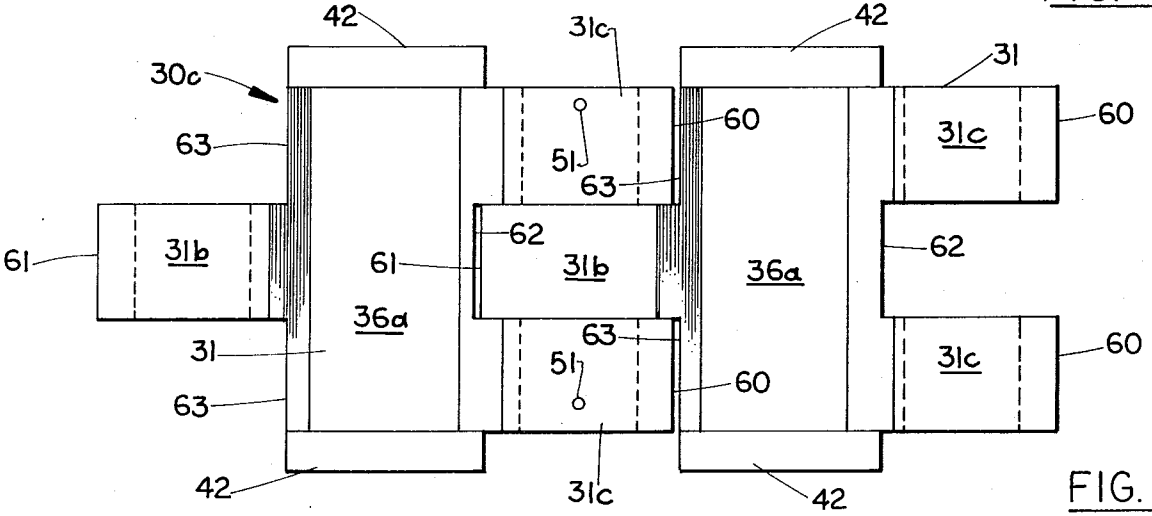
FIG. 13 is a plan view of a pair of interdigitated Y-shaped link elements in which provision has been made for prevention of backlash.

The chain 30*c* of FIG. 13 illustrates, among other things, the fact that a chain may be made up of Y-shaped link elements 31 according to this invention in which there is only one such Y-shaped link element per lateral "row". The link elements 31 of adjacent "rows" do interdigitate in the same manner as the Y-shaped link elements 31 making up the chains 30, 30*a* and 30*b*. In all instances the stem 31*b* of one Y-shaped link element 31 is received between the spaced parallel legs 31*c* of a Y-shaped link element 31 located in an adjacent "row". The drive for the chain 30*c* of FIG. 13 could be on the ends of the connecting pin or pintle 32 (not shown in that Fig.) or it would be possible to modify the Y-shaped link element to provide a cutaway portion indicated in dotted lines at 31*d* located centrally thereof on the bottom side of the link element and adapted to be engaged by the sprocket teeth.

The Y-shaped link elements of this invention may be provided with various other features. The Y-shaped link element 31 of FIGS. 18 through 20 has rounded or arcuate ends 31*e* and a central bridge 36, such bridge 36 being that portion of the Y-shaped link element which extends across the width of the element and from which the spaced, parallel legs 31*c* extend at right angles thereto on one side, and from which the centrally located stem 31*b* extends at right angles thereto on the other side. The link element is provided with a pair of sloping surfaces 34 and 35 which extend downwardly to a substantially horizontal surface 36*a*. These surfaces 34, 35 and 36*a* are adapted to accommodate a bit carrying lug 37 having a perforation 38 therein to receive the shank of a cutting bit and the like.

Figure 19:
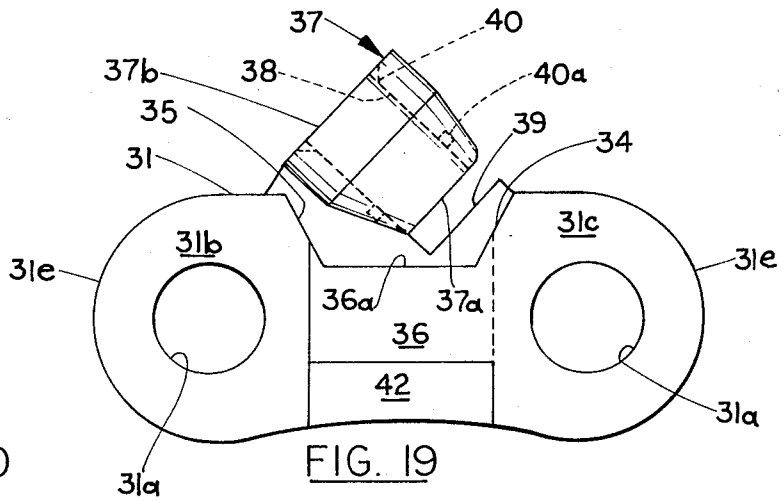
FIG. 19 is a side elevation of the Y-shaped link element and bit carrying lug of FIG. 18.
Figure 20:
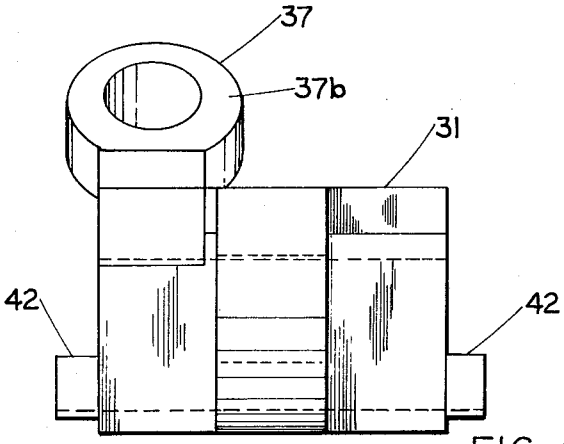
FIG. 20 is an end view of the Y-shaped link element and bit carrying lug of FIGS. 18 and 19.

The particular bit carrying lug 37 illustrated in FIGS. 19–20 includes an anvil 39 integral therewith and the lug may be welded in place on the described surfaces. Such lug may accommodate a rotatable, point attack bit such as is shown in U.S. Pat. No. 3,397,012 wherein a keeper will be disposed on the bit between the anvil 39 and the rear surface 37*a* of the lug 37. Such lug 37, however, could also be provided with a shoulder or bevel 40, and a retaining channel 40*a*, to receive a plumb-bob bit. Yet another arrangement would be to provide a bit having a flat shoulder to engage the front face 37*b* of the lug, the bit having a shank extending past the rear face 37*a*, a keeper being placed on such shank between the face 37*a* and anvil 39. In general, however, the particular bit utilized with the chain of this invention does not constitute a limitation thereon.

The Y-shaped link element of FIGS. 19 through 20 could also accommodate a bit carrying lug of the type shown in FIGS. 4 through 6. This lug 41 is also illustrated as accommodating a point attack bit but other bits could be utilized with it as is well understood in the art. And while the lug 41 has been indicated as a separate piece which is welded to a link element, it is to be understood that this lug, as well as that shown in FIG. 19, could be forged as an integral part of the Y-shaped link element.

In the link element-bit carrying lug arrangement of FIG. 6 the anvil 39*a* is shown as one of the surfaces (46, see FIG. 2) provided on the link element itself. It will be understood by those skilled in the art that a lug such as that shown at 41 in FIG. 6 could be substituted for the lug 37 of FIG. 19 and the lug 41 welded to the surface 35 in such manner that the surface 34 could act as an anvil against which a point attack bit could abut, when such bit is employed.

Figure 18:
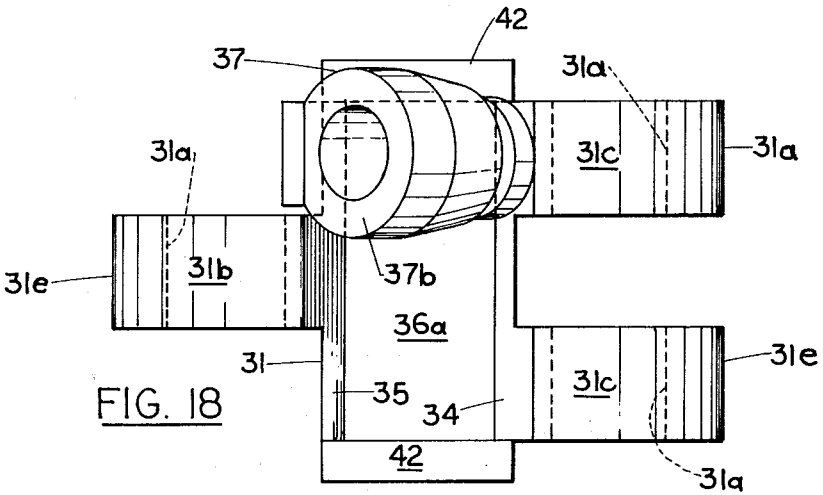
FIG. 18 is a plan view of a Y-shaped link element having a different style bit carrying lug affixed thereon.

The Y-shaped link element of FIGS. 18 through 20 is illustrated as having load bearing lugs 42 thereon. These lugs 42 are depicted as being located adjacent the bottom of the bridge portion 36 of the Y-shaped link element, at the ends of such bridge, and extending outwardly therefrom. It is desirable to utilize these lugs when the chain is supported at its sides. It will be apparent to those skilled in the art, however, that in some instances certain ones, at least, of such lugs will have to be omitted. Thus, for example, if lugs of the type shown in FIGS. 18 through 20 were to be utilized in the chain 30*b* of FIG. 12, those lugs 42 at the areas where the Y-shaped link elements abut one another laterally, would have to be removed. The chain 30*a* of FIG. 11 is another example of this; thus, there are lugs 42 on the outer sides of those Y-shaped link elements which are disposed at either side of the chain while the lugs 42 on the interior pair of abutting Y-shaped link elements have been omitted. It might be possible to provide a load bearing lug on the outer side of each of the interior link elements provided such lugs would not interfere with engagement of sprocket teeth with the spacers 33. A similar arrangement could be effected for the chain 30 of FIG. 1.

Figure 14:
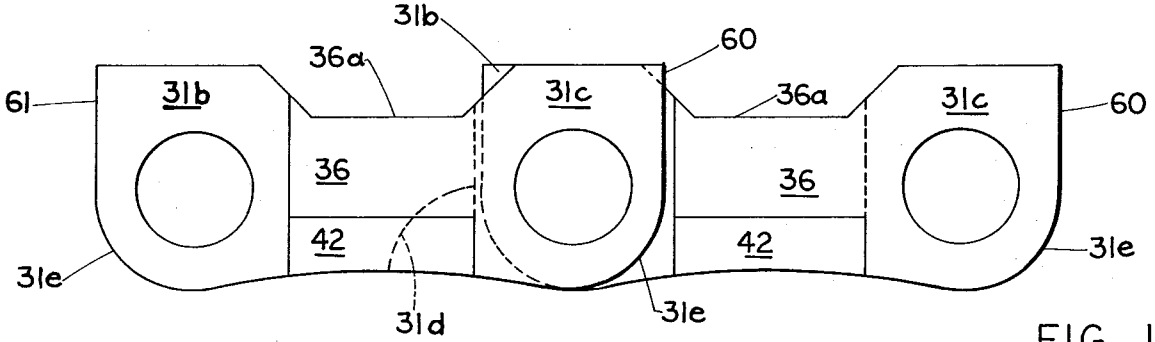
FIG. 14 is a side elevation of the pair of Y-shaped link elements depicted in FIG. 13.

Load bearing lugs 42 could be utilized on both sides of the single "row" of interdigitated Y-shaped link elements making up the chain 30*c* of FIGS. 13 and 14; this would be especially so if the chain were driven centrally thereof as indicated at 31*d*. If, however, the chain 30*c* were to be driven by tooth contact on the ends of the connecting pin or pintle 32, then these lugs 42 might have to be eliminated, or perhaps reduced in size. This of course would depend on what length connecting pin or pintle 32 could be employed in such chain.

Figure 15:
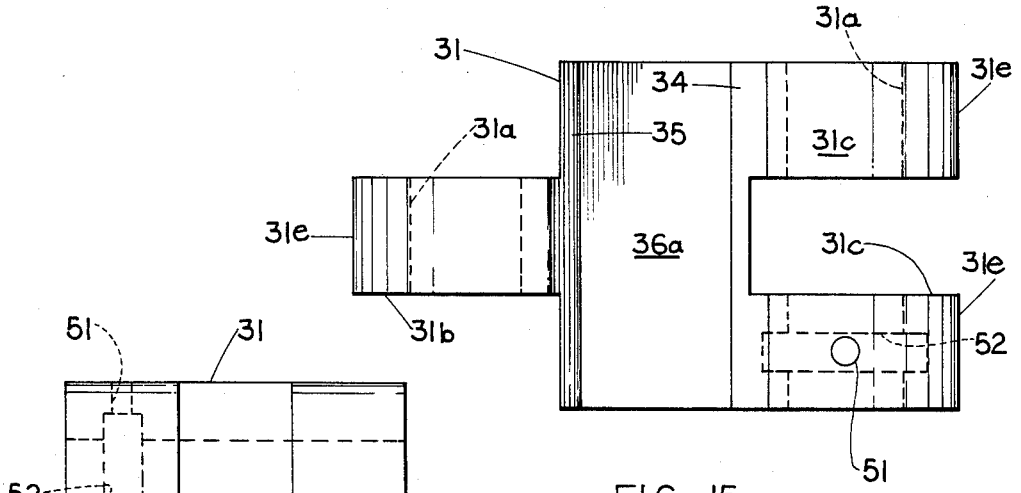
FIG. 15 is a plan view of a different style of Y-shaped link element illustrating one manner in which a connecting pin may be secured within such a Y-shaped link element.
Figure 17:
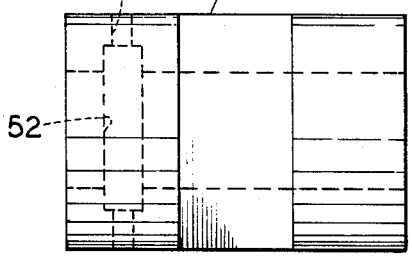
FIG. 17 is an end view of the Y-shaped link element of FIGS. 15 and 16.
Figure 16:
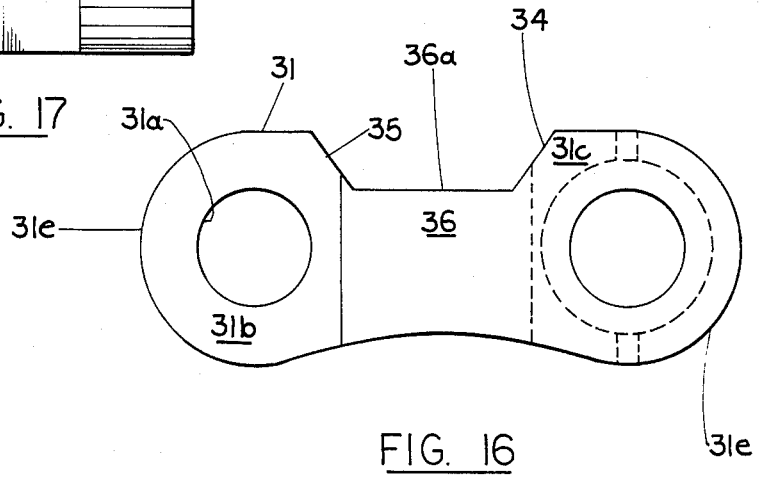
FIG. 16 is a side elevation of the Y-shaped link element of FIG. 15.

In FIGS. 15 through 17 the Y-shaped link element 31 has been depicted as formed without the load bearing lugs 42. In all other respects this lug is generally similar to that shown in FIGS. 18 through 20. It should also be observed that in the Y-shaped link elements such as those shown in FIGS. 13 through 23 the substantially horizontal surface 36*a* corresponds generally to the top of the central bridge portion 36 of the Y-shaped link element and it is from this central bridge 36 that the pair of spaced parallel legs 31*c* extends on one side, the leg or stem 31*b* extending from the other side and in alignment with the space defined by the legs 31*c*.

Figure 3:
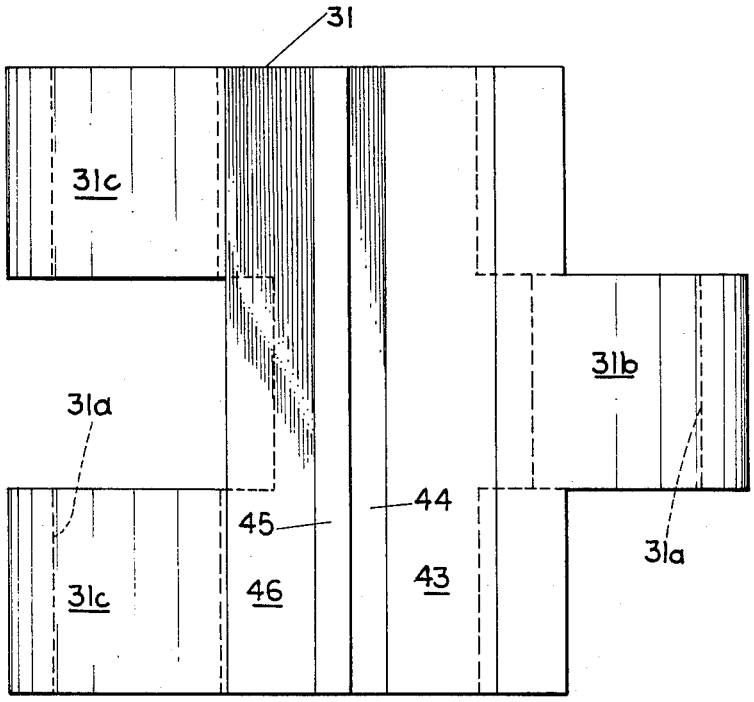
FIG. 3 is a plan view of the Y-shaped link element of FIG. 2.
Figure 2:
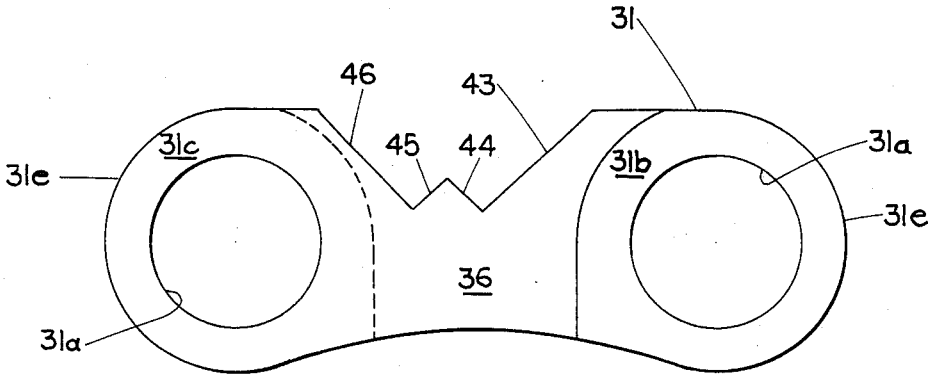
FIG. 2 is a side elevation of one type of Y-shaped link element constructed in accordance with the teachings of this invention.
Figure 7:
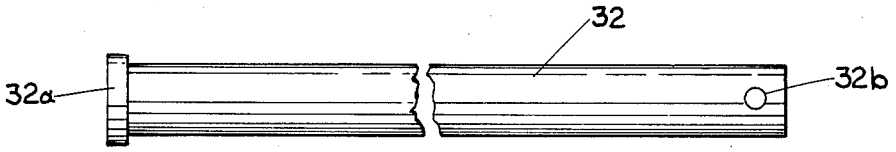
FIG. 7 illustrates a connecting pin which is utilized with a chain section made up of a plurality of interdigitated Y-shaped link elements according to this invention.
Figure 8:
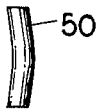
FIG. 8 is a view of a retaining pin which may be used with the connecting pin and a Y-shaped link element, all according to this invention.
Figure 9:
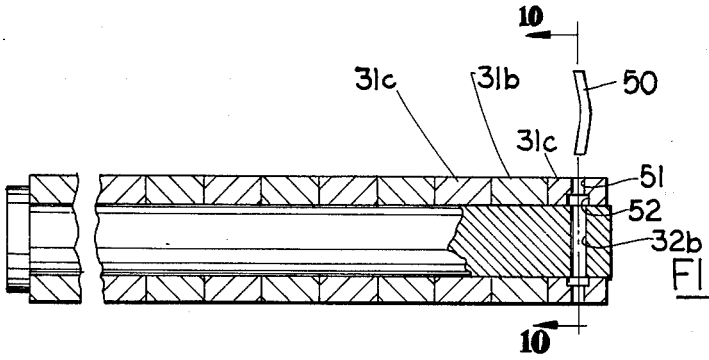
FIG. 9 is a fragmentary view, partly in section, showing the relationship among the connecting pin, retaining pin and a plurality of Y-shaped link elements.
Figure 10:
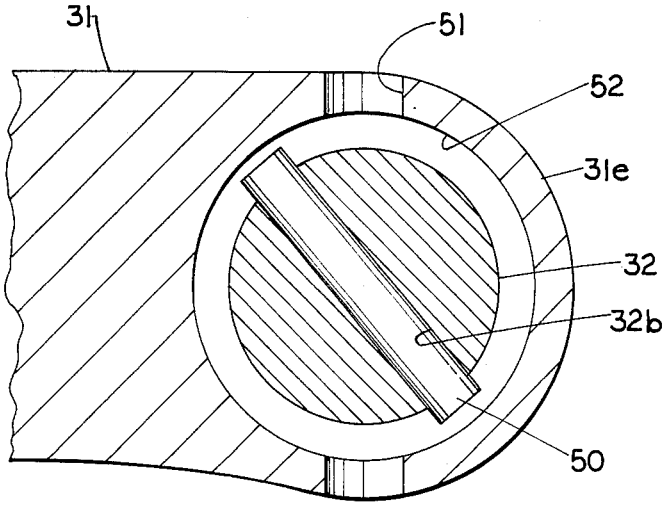
FIG. 10 is an enlarged section taken on the line 10—10 of FIG. 9 but showing the retaining pin in place.

FIGS. 2, 3 and 6 illustrate a modified Y-shaped link element wherein the top of the central bridge portion 36 of such element resembles the letter W when viewed in side elevation. Such top is comprised of the surfaces 43, 44, 45 and 46. As best seen in FIG. 6 a lug 41 may be welded or otherwise affixed to the surfaces 43 and 44, the surface 46 serving as an anvil (39*a*) against which a bit such as that shown in FIG. 6 may abut. (The surface 46 of FIG. 2 serves as the anvil 39*a* of FIG. 6.) As has been earlier mentioned herein, the Y-shaped link element 31 and bit carrying lug 41 could be forged as an integral unit as described in connection with the Y-shaped link element 31 and lug 37 of FIG. 18.

Figure 21:
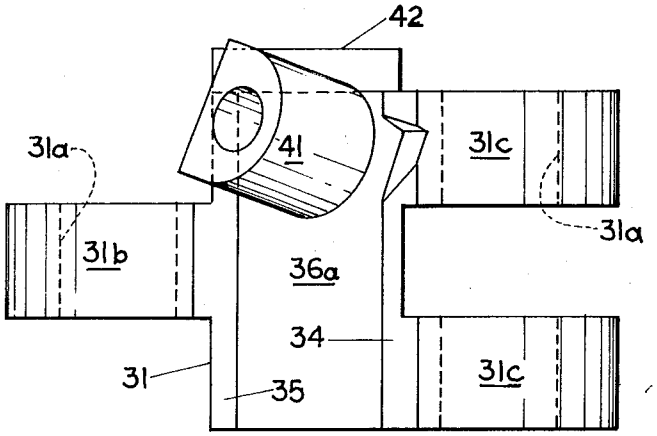
FIG. 21 is a plan view of a Y-shaped link element with a bit carrying lug affixed thereon at an orientation which differs from that of FIG. 18.
Figure 22:
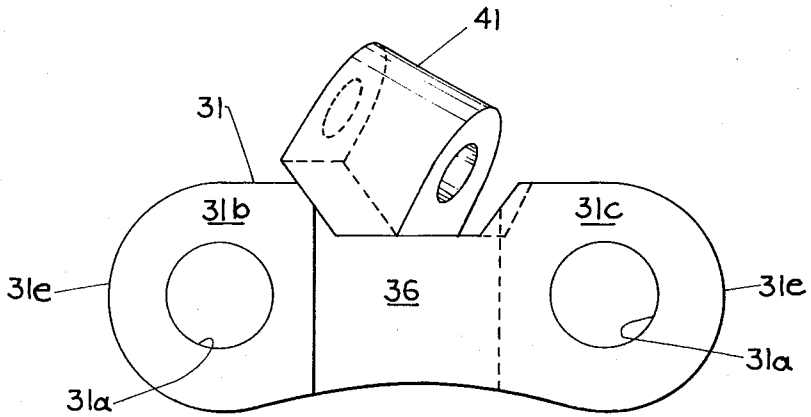
FIG. 22 is a side elevation of the Y-shaped link element and bit carrying lug of FIG. 21.
Figure 23:
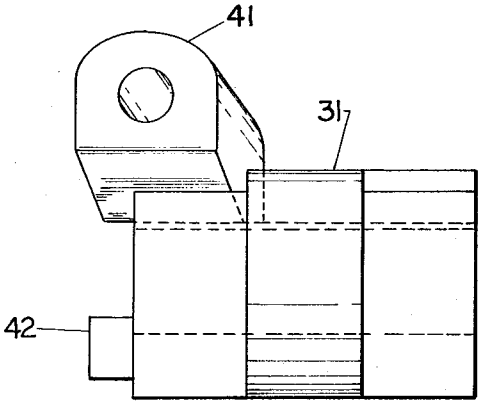
FIG. 23 is an end view of the Y-shaped link element and bit carrying lug of FIGS. 21 and 22.

FIGS. 21 through 23 illustrate a Y-shaped link element 31 in which a load carrying lug 42 is provided at only one side thereof. This type of lug might be utilized on a link element appearing at the outermost side of a chain and having another link element in the same row therewith, abutting it, in which case the abutting sides of such laterally placed link elements would have the load carrying lug 42 omitted.

These FIGS. 21–23 also illustrate the fact that the bit carrying lugs 41 may be skewed with respect to the line of chain movement, i.e., the cutting direction. This skewed arrangement is often desirable in order to increase the scope of material which may be reached and mined by the chain from a particular position. By way of examples only, such skewed lugs could be employed on outside link elements to further widen the cut, on interior link elements to eliminate kerfs or to provide clearance when needed, or to permit different bit spacings. In the manufacture of the Y-shaped link element 31 designed to accommodate a skewed bit carrying lug 41, the slopes of the surfaces 34, 35 and 36a may be adjusted so that in those instances wherein the bit extends through the lug 41 and abuts the surface 34, the abutting faces of the bit and surface 34 will be in alignment. The Y-shaped link element 31 may be forged to specifications to accommodate such arrangement or a standard Y-shaped link element 31 could be machined to provide the appropriate bearing surfaces.

The Y-shaped link elements making up the chains of FIGS. 1, 11, 12 and 13 have been illustrated as being joined by connecting pins or pintles 32. In this connection it will be understood that additional Y-shaped link elements and connecting pins may be added to either end (the right and left as viewed in the Figs.) of the chain so as to achieve a chain of any desired length as circumstances may require. Additional Y-shaped link elements may also be added to the sides (the top and bottom as viewed in the Figs.) of the chains to achieve a chain of any desired width; this is best seen in FIGS. 1, 11 and 12. The chain of FIG. 13 illustrates the fact that there could be a chain comprised of a single strand of Y-shaped link elements wherein there is only one link element per "row", the stem 31*b* of one such element being engaged between the spaced pair of legs 31*c* of an adjacent link element, the stem and legs being joined by a connecting pin or pintle 32. If certain of the lugs 42 were omitted, additional strands could be located flush against one another on the same connecting pins or pintles.

Two different styles of connecting pins or pintles have been illustrated. In FIGS. 1 and 11 the connecting pin 32 is provided at one end with a head 32*a* and at the other end with a perforation 32*b* adapted to receive a pin 50 (see FIGS. 7 through 10 which will be described in detail shortly) driven through a corresponding perforation 51 in the outermost leg of the Y-shaped link element furtherest removed from the connecting pin head 32*a*. The connecting pin or pintle 32 of FIGS. 12 and 13 is like that of FIGS. 1 and 11 except that the head 32*a* has been omitted and perforations 32*b* utilized at both ends. In this arrangement the perforations 32*b* each receives a retaining pin 50 driven through corresponding perforations 51 in the outermost leg of each Y-shaped link element disposed at the outer sides of the chain. It should also be noted, however, as will be understood by those skilled in the art, that there are other ways in which the connecting pins or pintles 32 may be satisfactorily secured. Some of these, for example, are shown in U.S. Pat. Nos. 3,679,265 and 3,888,133.

In FIGS. 7 through 10 the relationship among the Y-shaped link element 31, connecting pin 32, head 32*a* perforation 32*b*, retaining pin 50 and link perforation 51 is shown in detail. In addition, that leg 31*c* of the link element 31 which is disposed at the outermost side of the chain is provided with an annular groove 52 to receive the retaining pin 50. Such pin 50, of course, must be longer than the diameter of the connecting pin 32 and shorter than the diameter of the annular groove 52; this insures that those link elements and/or spacer elements which are joined by a particular connecting pin 32 will be maintained thereon between the connecting pin head 32*a* and that link element 31 which is secured at the opposite end of the connecting pin 32 by the retainer pin 50 located within the perforation 32*b* and extending into the groove 52. This permits the pin 50 to rotate in the groove 52. It should be further noted that the retaining pin 50 is bent slightly, and the pin 50 manufactured of such metal or other substance, so that when the pin 50 is forced through the link perforation 51 and connecting pin perforation 32*b* it will be retained in the perforation 32*b* with an interference fit. This same arrangement may be employed at both ends of the connecting pin 32 when chains like that of FIGS. 12 and 13 are utilized.

Modifications may be made in this invention as will be understood by those skilled in the art. FIG. 13 depicts one of these. Thus, it is desirable to alleviate what is known in the industry as "backlash", i.e., to minimize sagging of the chain during its driving between chain sprockets. A companion application filed of even date herewith illustrates how this can be accomplished with chains made up of link elements such as those shown in U.S. Pat. Nos. 3,679,265 and 3,888,133. Another companion application, also filed of even date herewith, illustrates how backlash is minimized when the chain is comprised of H-shaped link elements.

In order to minimize backlash in chains comprised of Y-shaped link elements, the Y-shaped link elements 31 such as shown in FIGS. 2 and 16 have been modified as shown in FIG. 13. In the link elements of those FIGS. 2 and 16 the end of the stem 31*b* and the ends of the spaced parallel legs 31*c* are arcuate as indicated at 31*e*. The Y-shaped link element of FIG. 13, however, has been modified so that the leg ends 31*e* include a portion 60 which is substantially vertical and so that the stem end 31*e* includes a substantially vertical portion 61. That portion of the central bridge portion 36 of the Y-shaped link element which is between the spaced parallel legs 31*c* is also substantially vertical as indicated at 62; so also are the bridge surfaces 63 at either side of the stem 31*b*. A clearance is provided between the portions 61 and 62.

Thus, considering the chain of FIGS. 13 and 14 as moving from right to left as viewed therein, the aforementioned clearance, coupled with the arcuate portion 31*e* of the link element, permits the chain to pass downwardly over a sprocket. Should, however, the lefthand link 31, as viewed in these Figs., be urged in a clockwise direction by the forces such as are encountered during mining, the substantially vertical surfaces 60 on the ends of the legs 31*c* of the lefthand link element will engage the substantially vertical surfaces 63 disposed at either side of the stem 31*b* of the righthand link element, and this prevents further clockwise movement, backlash, of the link element. Again, the clearance between the substantially vertical surfaces 60 and 63 permits enough counterclockwise movement of the link elements such that they can pass over the various driving and idler sprockets.

Figure 24:
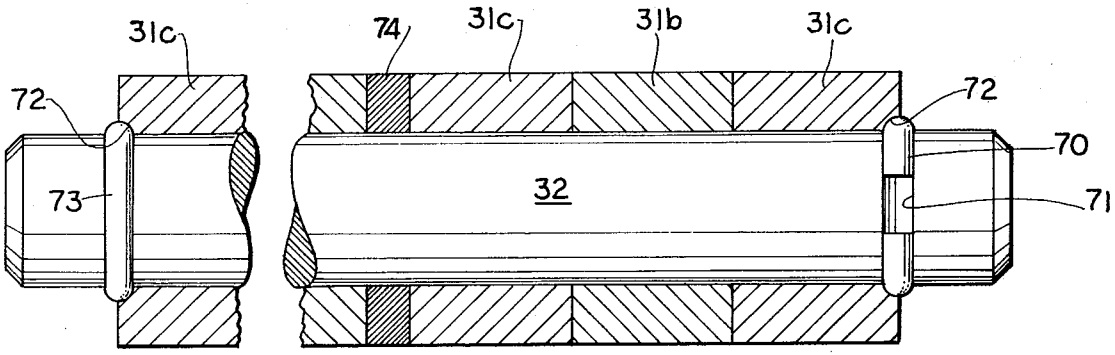
FIG. 24 is a fragmented view, partly in section, illustrating a modification of the means for retaining the connectig pin or pintle in an assembly of link elements.
Figure 25:
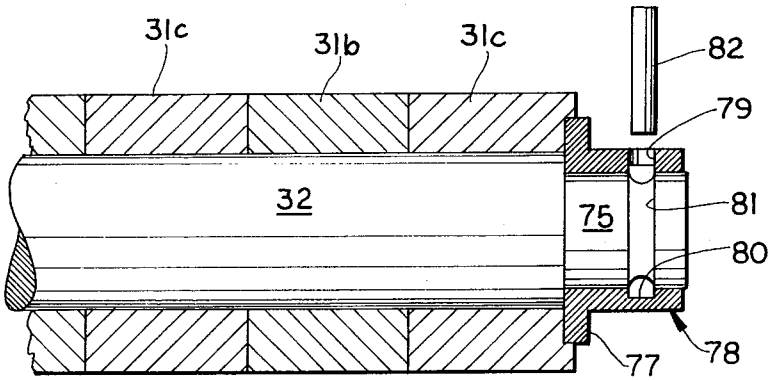
FIG. 25 is a fragmented view, partly in section, illustrating a further modification of the means for retaining the connecting pin or pintle in an assembly of link elements.

As earlier mentioned herein, see for example the discussion of FIGS. 1 and 7–13 respecting the connecting pin or pintle 32, various arrangements may be utilized to secure the pin or pintle in an assembly of link elements. Additional modifications are illustrated in FIGS. 24 and 25. In the arrangement of FIG. 24 a plurality of interdigitated Y-shaped link elements 31 is retained by means of a pair of abutments provided adjacent the outermost link elements at each end of a row thereof. As depicted at the righthand side of FIG. 24 one of the abutments may be comprised of a split ring 70 located in a groove 71 provided adjacent the end of the pintle 32. Preferably this split ring 70 is also at least in part received within an annular undercut 72 provided at the outermost edge of the outermost link element at that end of the row. The split ring 70 will have sufficient resiliency to enable it to be located within the groove 71.

That end of the connecting pin 32 which is seen at the lefthand side of the arrangement of FIG. 24 may be arranged like the righthand side just described, or the abutment may be comprised of a permanent protuberance 73. Preferably the outer side of the link disposed at the lefthand side of the assembly of link elements will also be provided with an annular undercut 72 to receive the abutment 73. In order to accomplish this arrangement a spacer 74 is provided between adjacent pairs of interdigitated Y-shaped link elements. This spacer 74 is forced into position after the connecting pin or pintle 32 has been located within the assembled link elements 31 so as to spread apart the adjacent interdigitated link elements whereby to force the retainer 70 and abutment 73 into engagement within their respective undercut portions 72. If it becomes necessary to remove the connecting pin for any reason, this is accomplished by first removing the spacer 74 whereafter the endmost link elements 31 may be disengaged from the retainer element 70 and abutment 73.

In FIG. 25 a somewhat different arrangement is provided. As seen at the righthand side of that Fig., the end of the connecting pin or pintle 32 is preferably provided with a turned-down extension 75. The outer side of the endmost link at that end of the Fig. is provided with the undercut portion 76 to receive the flange 77 of a hat-shaped retainer element 78 which slides over the extension 75. This hat-shaped element 78 is provided with an opening 79 which terminates within an annular groove 80 provided therein. The pin extension 75 is provided with a corresponding annular groove 81. In order to retain the hat-shaped element 78 in the pin extension 75 a retaining pin 82 is driven through the hole 79 into the cooperating annular grooves 80 and 81 in the element 78 and extension 75 respectively. It would also be possible to replace the grooves 80 and 81 with another hole (not shown) in the extension 75, aligned with the hole 79, and to drive the pin 82 into both holes.

It will be understood by those skilled in the art that the lefthand side of the arrangement of FIG. 25 could be like that shown at the lefthand side of FIG. 24, for example, or it could also be a repeat of what is shown at the righthand side of FIG. 25. A spacer 74 may also be utilized in the manner of FIG. 24 depending on the precise nature of the retaining element selected for the lefthand side of the FIG. 25 arrangement.

Other modifications may be made in this invention without departing from the scope and spirit thereof, and while the invention has been shown and described in terms of certain particular arrangements, patterns and structures, the invention is not to be limited to those particular arrangements, patterns and structures except insofar as they are specifically set forth in the subjoined claims.

What is claimed is:

1. In a continuous chain for a mining machine or the like comprising a plurality of link elements arranged in rows extending across the width of the chain, at least some of said link elements constituting bit carrying link elements, the ends of said link elements having perforations therein for receiving a connecting pin, adjacent rows of said link elements being interdigitated so that the perforations in said interdigitated link elements are in alignment, a connecting pin received in said aligned perforations, and means to retain said connecting pin in said aligned perforations; the improvement which comprises: said link elements being Y-shaped when viewed in plan, each said Y-shaped link element having a central bridge portion with two sides and two ends, and a pair of spaced parallel legs extending from one side thereof at right angles thereto, and a centrally located stem extending from the other side thereof at right angles thereto, said stem being aligned between said legs, said legs and said stem being parallel to the direction of chain movement, said central bridge being of such dimension from end-to-end as to be capable of supporting thereon one or more bit carrying lugs in a variety of positions.

2. The chain of claim 1 in which each of said rows is comprised of a plurality of Y-shaped link elements.

3. The chain of claim 1 in which each of said Y-shaped bit carrying link elements is provided with a bit carrying lug having a perforation therein to receive a bit.

4. The chain of claim 3 in which said lug is fixed on said central bridge portion.

5. The chain of claim 4 in which said central bridge portion is provided with an abutment surface against which a bit may abut.

6. The chain of claim 3 in which said bit carrying lug includes a bit abutment surface.

7. The chain of claim 3 in which said last mentioned perforation is in line with said direction of chain movement.

8. The chain of claim 3 in which said last mentioned perforation is skewed with respect to said direction of chain movement.

9. The chain of claim 1 including a load bearing lug adjacent an end of said central bridge portion and extending outwardly therefrom.

10. The chain of claim 1 including a load bearing lug at both ends of said central bridge portion.

11. The chain of claim 1 in which the means to retain said connection pin in said aligned perforations includes a retaining pin, a perforation in said connecting pin to receive said retaining pin with an interference fit, said retaining pin being longer than the diameter of said connecting pin, a hole in a said link element through which said retaining pin may pass, and an annular channel in said link element in the region of said hole, said retaining pin being shorter than the diameter of said channel, whereby said retaining pin may rotate within said channel.

12. The chain of claim 1 in which the ends of said legs and the end of said stem are arcuate, the sides of said central bridge portion between said spaced parallel legs and adjacent said stem being substantially vertical when the Y-shaped link element is viewed in side elevation.

13. The chain of claim 1 in which the ends of said legs, the end of said stem, and the sides of said central bridge portion between said spaced parallel legs and adjacent said stem, are all substantially vertical when the Y-shaped link element is viewed in side elevation, whereby the tendency of said chain to sag is resisted by engagement of a vertical, interdigitated leg end with a vertical bridge side so that the backlash is alleviated.

14. The chain of claim 1 in which said central bridge portion is comprised of a plurality of surfaces which define an area in which a bit carrying lug may be situated, said surfaces being comprised of a horizontal surface and a first sloping surface, said first sloping surface extending downwardly from said stem towards said horizontal surface.

15. The chain of claim 14 including a bit carrying lug mounted on said first sloping surface.

16. The chain of claim 15 including a second sloping surface constituting an abutment surface against which a bit may abut, said second sloping surface extending downwardly from said pair of spaced parallel legs towards said horizontal surface.

17. The chain of claim 16 in which said bit carrying lug includes an integral bit abutment surface, said bit carrying lug also engaging said horizontal surface and said second sloping surface, said integral bit abutment surface overlying said second sloping surface.

18. The chain of claim 1 in which the top of said central bridge portion is comprised of a plurality of surfaces which impart a W-shape to said Y-shaped bit carrying link element when viewed in side elevation.

19. The chain of claim 18 including a bit carrying lug mounted on two of said surfaces, a third one of said surfaces constituting an abutment surface against which a bit may abut.

20. The chain of claim 1 in which each of said rows is comprised of four Y-shaped link elements, and said chain including a row of aligned spacer elements located on said connecting pins centrally of said chain so as to separate each of said rows into two groups of two Y-shaped link elements, groups of Y-shaped link elements in adjacent rows being interdigitated, whereby said spacer elements may be engaged by the teeth of a chain sprocket located centrally of said chain.

21. The chain of claim 1 in which each of said rows is comprised of four Y-shaped link elements, and said chain including two strands of aligned spacer elements on said connecting pins arranged so as to separate the endmost Y-shaped link element at each end of each row of link elements from the center pair of Y-shaped link elements of each row of link elements, whereby each of said two strands of aligned spacers may be engaged by the teeth of chain sprockets located inwardly from the sides of said chain.

22. The chain of claim 1 in which each of said rows is comprised of two Y-shaped link elements, and said connecting pins having end portions which extend beyond the sides of said chain, whereby said end portions may be engaged by the teeth of chain sprockets located at the sides of said chain.

23. The chain of claim 1 in which each of said rows having only a single Y-shaped link element thereon, all of said links of said chain being substantially identical with respect to overall length, width and size and location of said legs and stem, the stem of a Y-shaped link element on one row being received between the pair of spaced parallel legs on the Y-shaped link element of an adjacent row, the perforations in said legs and stem being aligned, and said connecting pin passing through said aligned perforations.

24. The chain of claim 1 in which the said means to retain said connecting pin in said aligned perforations includes an abutment on one end of said connecting pin to abut the outer side of a link element at one end of a row and a hole in and adjacent the other end of said connecting pin, a corresponding hole on that link element which is at the other end of said row, and a retaining pin having an interference fit within both of said holes.

25. The chain of claim 1 in which the said means to retain said connecting pin in said aligned perforations includes a pair of holes in said connecting pin, one hole adjacent each end of said connecting pin, each of the outermost link elements at each end of a row of said link elements having a hole therein aligned with one of the holes in said connecting pin, and a pair of retaining pins, each retaining pin having an interference fit with a pair of said aligned holes.

26. The chain of claim 1 in which the said means to retain said connecting pin in said aligned perforations includes an annular groove in and adjacent one end of said connecting pin, an abutment means at the other end of said connecting pin to engage an endmost link element of a row of link elements, and a split ring within said groove, said split ring abutting the endmost link element at the other end of said row of link elements.

27. The chain of claim 26 in which said last mentioned link element is provided with an annular undercut to receive said split ring.

28. The chain of claim 27 including a spacer on said connecting pin located between pairs of interdigitated link elements whereby to force said split ring into said annular undercut.

29. The chain of claim 1 in which the said means to retain said connecting pin in said aligned perforations includes an abutment means at one end of said connecting pin to engage an endmost link element at one end of a row of link elements, a hat-shaped member disposed on the other end of said connecting pin, a first hole in said hat-shaped member, a second hole in said connecting pin, said first and said second holes being aligned, and a retaining pin secured in said aligned holes, said hat-shaped member abutting the endmost link element at the other end of said row of link elements.

30. The chain of claim 29 in which said last mentioned link element is provided with a recess to receive a part at least of said hat-shaped member.

31. The chain of claim 29 in which said hat-shaped member has a bore to enable it to be slipped on said other end of said connecting pin, said hat-shaped member having an arcuate groove therein within said bore and communicating with said first hole, and said second hole comprising an arcuate groove on said other end of said connecting pin, said retaining pin being disposed in said arcuate grooves.

32. The chain of claim 1 in which the said means to retain said connecting pin in said aligned perforations includes an abutment means fixed at each end of said connecting pin, each of said abutment means engaging that endmost link element, of a row of link elements disposed on said connecting pin, which is adjacent thereto, the outer side of at least one of said endmost link elements being adapted to receive a portion at least of that abutment means which engages it.

* * * * *